US005942341A

United States Patent [19]

Hayashi et al.

[11] Patent Number: 5,942,341

[45] **Date of Patent: *Aug. 24, 1999**

[54] MAGNETORESISTIVE ELEMENT

[75] Inventors: Kazuhiko Hayashi; Hidefumi Yamamoto; Jun-ichi Fujikata; Kunihiko Ishihara, all of Tokyo, Japan

[73] Assignee: NEC Corporation, Tokyo, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 08/730,272

[22] Filed: Oct. 15, 1996

[30] Foreign Application Priority Data

Oct. 15, 1995 [JP] Japan ..... 7-291953

[51] Int. Cl.[6] ..... B32B 9/00

[52] U.S. Cl. ..... 428/693; 428/692; 428/611; 428/668; 428/672; 428/673; 428/675; 428/676; 428/679; 338/32 F; 360/113; 324/252

[58] Field of Search ..... 428/692, 693, 428/611, 668, 672, 673, 675, 676, 679; 338/32 R; 360/113; 324/252

[56] References Cited

U.S. PATENT DOCUMENTS

| | | | |
|---|---|---|---|
| 3,350,180 | 10/1967 | Croll | 29/183.5 |
| 4,734,644 | 3/1988 | Imakoshi et al. | 324/252 |
| 4,929,514 | 5/1990 | Natarajan et al. | 428/611 |
| 5,147,732 | 9/1992 | Shiroishi et al. | 428/668 |
| 5,344,706 | 9/1994 | Lambeth et al. | 428/336 |
| 5,508,867 | 4/1996 | Cain et al. | 360/113 |
| 5,652,054 | 7/1997 | Kikitsu et al. | 428/328 |
| 5,963,426 | 12/1997 | Lee et al. | 428/611 |

OTHER PUBLICATIONS

Mouchot et al., "Magnetoresistive Sensors Based on Ni81Fe19/Ag Multilayers", IEEE Transactions On Magnetics, pp. 2732–2734, Nov. 30, 1993.

*Primary Examiner*—Nam Nguyen
*Assistant Examiner*—Steven H. VerSteeg
*Attorney, Agent, or Firm*—Young & Thompson

[57] ABSTRACT

A magnetoresistive element includes a first magnetic layer; and laminations of a second magnetic layer, a non-magnetic layer and a third magnetic layer. The laminations are adjacent to the first magnetic layer. The second magnetic layer and the third magnetic layer have different coercive forces, wherein the first magnetic layer is selected from CoCrTa, NdFe, and alloys thereof.

31 Claims, 3 Drawing Sheets

MAGNETORESISTIVE ELEMENT

BACKGROUND OF THE INVENTION

The present invention relates to a magnetoresistive element, a method for forming a magnetoresistive element, a yoke magnetoresistive head including a magnetoresistive element, a shield magnetoresistive head including a magnetoresistive element, a magnetoresistive sensor and a magnetic recording and replaying system.

SUMMARY OF THE INVENTION

Accordingly, it is an object of the present invention to provide an improved magnetoresistive element.

It is a further object of the present invention to provide a method for forming a magnetoresistive element.

It is a further object of the present invention to provide a yoke magnetoresistive head including a magnetoresistive element retreated from an ABS face.

It is still a further object of the present invention to provide a shield magnetoresistive head including a magnetoresistive element sandwiched by soft magnetic layer shield films.

It is yet a further object of the present invention to provide a magnetoresistive sensor.

It is moreover an object of the present invention to provide a magnetic recording and replaying system.

The above and other objects, features and advantages of the present invention will be apparent from the following descriptions.

The present invention provides a magnetoresistive element comprising a first magnetic layer; and laminations of a second magnetic layer, a non-magnetic layer and a third magnetic layer. The laminations are adjacent to said first magnetic layer. The second magnetic layer and the third magnetic layer have different coercive forces, wherein the first magnetic layer comprises one selected from the group consisting of CoCr, CoCrPt, CoCrTa and an alloy including any of CoCr, CoCrPt, CoCrTa as a main component.

The present invention also provides a magnetoresistive element comprising a first magnetic layer, and laminations of a non-magnetic layer and a third magnetic layer. The laminations are adjacent to said first magnetic layer. The first magnetic layer and the third magnetic layer have different coercive forces, wherein the first magnetic layer comprises one selected from the group consisting of CoCr, CoCrPt, CoCrTa and an alloy including any of CoCr, CoCrPt, CoCrTa as a main component.

The present invention also provides a magnetoresistive element comprising a first magnetic layer, and laminations of a second magnetic layer, a non-magnetic layer and a third magnetic layer. The laminations are adjacent to said first magnetic layer. The second magnetic layer and the third magnetic layer have different coercive forces, wherein the first magnetic layer comprises one selected from the group consisting of SmCo, NdFe and an alloy including any of SmCo, NdFe as a main component.

The present invention also provides a magnetoresistive element comprising a first magnetic layer, and laminations of a non-magnetic layer and a third magnetic layer. The laminations are adjacent to said first magnetic layer. The first magnetic layer and the third magnetic layer have different coercive forces, wherein the first magnetic layer comprises one selected from the group consisting of SmCo, NdFe and an alloy including any of SmCo, NdFe as a main component.

The present invention also provides a method for forming a magnetoresistive element comprising a first magnetic layer, and laminations of a second magnetic layer, a non-magnetic layer and a third magnetic layer. The laminations are adjacent to said first magnetic layer. The second magnetic layer and the third magnetic layer have different coercive forces, wherein the first magnetic layer is made of one selected from the group consisting of CoCr, CoCrPt, CoCrTa, SmCo, NdFe and an alloy including any of CoCr, CoCrPt, CoCrTa, SmCo, NdFe as a main component, and the first magnetic layer is heated at a temperature in the range of 150–250° C.

The present invention also provides a method for forming a magnetoresistive element comprising a first magnetic layer, and laminations of a non-magnetic layer and a third magnetic layer. The laminations are adjacent to said first magnetic layer. The first magnetic layer and the third magnetic layer have different coercive forces, wherein the first magnetic layer is made of one selected from the group consisting of CoCr, CoCrPt, CoCrTa, SmCo, NdFe and an alloy including any of CoCr, CoCrPt, CoCrTa, SmCo, NdFe as a main component, and the first magnetic layer is heated at a temperature in the range of 150–250° C.

The present invention also provides a yoke magnetoresistive head including a magnetoresistive element retreated from an ABS face. The magnetoresistive element comprising a first magnetic layer, and laminations of a second magnetic layer, a non-magnetic layer and a third magnetic layer. The laminations are adjacent to said first magnetic layer. The second magnetic layer and the third magnetic layer have different coercive forces, wherein the first magnetic layer comprises one selected from the group consisting of CoCr, CoCrPt, CoCrTa and an alloy including any of CoCr, CoCrPt, CoCrTa as a main component.

The present invention also provides a yoke magnetoresistive head including a magnetoresistive element retreated from an ABS face. The magnetoresistive element comprises a first magnetic layer, and laminations of a non-magnetic layer and a third magnetic layer, the laminations being adjacent to said first magnetic layer. The first magnetic layer and the third magnetic layer have different coercive forces, wherein the first magnetic layer comprises one selected from the group consisting of CoCr, CoCrPt, CoCrTa and an alloy including any of CoCr, CoCrPt, CoCrTa as a main component.

The present invention also provides a shield magnetoresistive head including a magnetoresistive element sandwiched by soft magnetic layer shield films. The magnetoresistive element comprises a first magnetic layer, and laminations of a second magnetic layer, a non-magnetic layer and a third magnetic layer. The laminations are adjacent to said first magnetic layer. The second magnetic layer and the third magnetic layer have different coercive forces, wherein the first magnetic layer comprises one selected from the group consisting of CoCr, CoCrPt, CoCrTa and an alloy including any of CoCr, CoCrPt, CoCrTa as a main component.

The present invention also provides a shield magnetoresistive head including a magnetoresistive element sandwiched by soft magnetic layer shield films. The magnetoresistive element comprises a first magnetic layer, and laminations of a non-magnetic layer and a third magnetic layer. The laminations are adjacent to said first magnetic layer. The first magnetic layer and the third magnetic layer have different coercive forces, wherein the first magnetic layer comprises one selected from the group consisting of CoCr, CoCrPt, CoCrTa and an alloy including any of CoCr, CoCrPt, CoCrTa as a main component.

The present invention also provides a magnetoresistive sensor comprising the following elements. A magnetoresistive sensor comprises a first magnetic layer, and laminations of a non-magnetic layer and a third magnetic layer. The laminations are adjacent to said first magnetic layer. The first magnetic layer and the third magnetic layer have different coercive forces, wherein at least one of the second and third magnetic layers comprises one selected from the group consisting of NiFe, NiFeCo, FeCo, Co. A current applying means is provided for applying a current to the magnetoresistive sensor. A sensor means is provided for sensing a variation in resistivity of the magnetoresistive sensor based upon a rotational difference of magnetization of the third magnetic layer from a direction of magnetization of the second magnetic layer in accordance with a magnetic field to the detected.

The present invention also provides a magnetic recording and replying system comprising the following elements. A magnetic recording medium is provided having a plurality of tracks for recording data. A magnetic convector is provided for converting a magnetic intensity into an electric intensity. The magnetic convector are maintained adjacent to the magnetic recording medium during a relative motion in relation to the magnetic recording medium. The magnetic convector comprises first, second and third ferromagnetic layers which are separated by non-magnetic metal layers. The second and third ferromagnetic layers are vertical to the magnetic recording medium. The first magnetic layer is adjacent to the second magnetic layer. The first magnetic layer comprises one selected from the group consisting of CoCr, CoCrPt, CoCrTa, SmCo, NdFe and an alloy including any of CoCr, CoCrPt, CoCrTa, SmCo, NdFe as a main component. An actuator means is coupled to the magnetic convector for moving the magnetic convector to a selected one of the tracks of the magnetic recording medium. A detector means is coupled to the magnetic convector for detecting variation in internal resistance of the magnetic convector by a magnetic field provided from a magnetic domain recorded in the magnetic recording medium.

BRIEF DESCRIPTION OF THE DRAWINGS

Preferred embodiments according to the present invention will be described with reference to the accompanying drawings.

DISCLOSURE OF THE INVENTION

Figure 1:
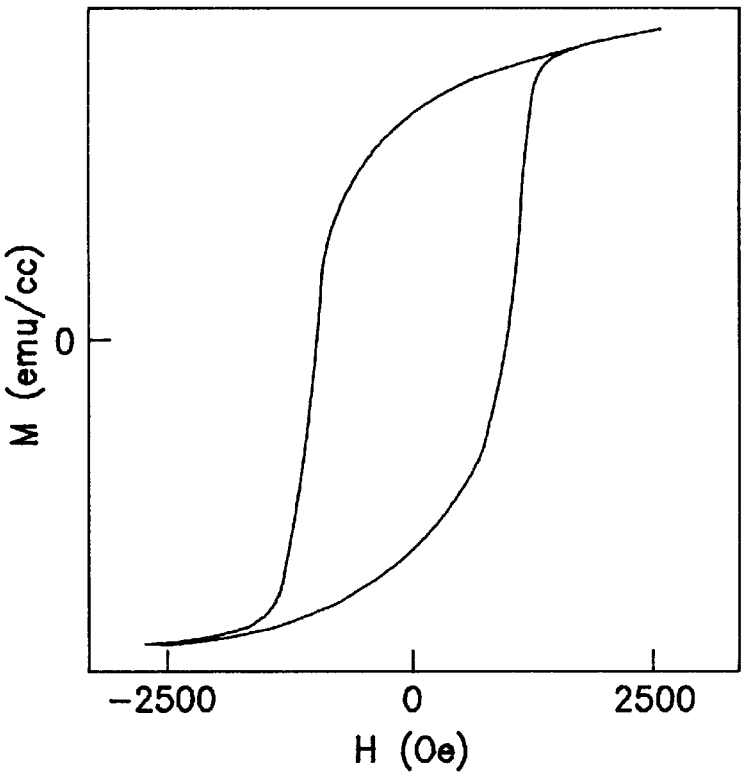
FIG. 1 is a diagram illustrative of an M—H loop in-plane direction of glass/Cr/CoCrPt film.

The present invention provides a magnetoresistive element comprising a first magnetic layer; and laminations of a second magnetic layer, a non-magnetic layer and a third magnetic layer. The laminations are adjacent to said first magnetic layer. The second magnetic layer and the third magnetic layer have different coercive forces, wherein the first magnetic layer comprises one selected from the group consisting of CoCr, CoCrPt, CoCrTa and an alloy including any of CoCr, CoCrPt, CoCrTa as a main component.

It is preferable that the CoCr layer comprises 6–20% of Cr, and 94-80% of alloy of Co and CoCr.

It is preferable that the CoCrPt layer comprises 0–20% of Cr, 0–30% of Pt and the remaining part of alloy of Co and CoCrPt.

It is preferable that the CoCrTa layer comprises 6–20% of Cr, 0–8% of Ta and the remaining parts of alloy of Co and CoCrTa.

The thickness of the above individual magnetic layers is not more than 300 angstroms but not less than 4 angstroms. If the thickness is less than 4 angstroms, the Curie point is below room temperature.

The thickness of the above non-magnetic layer is 4–50 angstroms.

If CoCr, CoCrPt, CoCrTa, SmCo, or NdFe film is laminated with Co, NiFe, NiFeCo film, then a ferromagnetic coupling is caused whereby coercive force of the magnetic layers in contact with CoCrPt is increased. CoCr, CoCrPt, CoCrTa, SmCo, or NdFe has a superior anti-corrosiveness than FeMn.

A Cr base layer underlying the first magnetic layer is further provided.

The second magnetic layer comprises one selected from the group consisting of NiFe, NiFeCo, FeCo, Co and an alloy including any of NiFe, NiFeCo, FeCo, Co as a main component.

The third magnetic layer comprises one selected from the group consisting of NiFe, NiFeCo, FeCo, Co and an alloy including any of NiFe, NiFeCO, FeCo, Co as a main component.

The non-magnetic layer comprises one selected from the group consisting of Cu and an alloy including Cu as a main component.

The non-magnetic layer comprises one selected from the group consisting of Au and an alloy including Au as a main component.

The non-magnetic layer comprises one selected from the group consisting of Ag and an alloy including Ag as a main component.

The present invention also provides a magnetoresistive element comprising a first magnetic layer, and laminations of a non-magnetic layer and a third magnetic layer. The laminations are adjacent to said first magnetic layer. The first magnetic layer and the third magnetic layer have different coercive forces, wherein the first magnetic layer comprises one selected from the group consisting of CoCr, CoCrPt, CoCrTa and an alloy including any of CoCr, CoCrPt, CoCrTa as a main component.

It is preferable that the CoCr layer comprises 6–20% of Cr, and 94-80% of alloy of Co and CoCr.

It is preferable that the CoCrPt layer comprises 0–20% of Cr, 0–30% of Pt and the remaining part of alloy of Co and CoCrPt.

It is preferable that the CoCrTa layer comprises 6–20% of Cr, 0–8% of Ta and the remaining parts of alloy of Co and CoCrTa.

The thickness of the above individual magnetic layers is not more than 300 angstroms but not less than 4 angstroms. If the thickness is less than 4 angstroms, the Curie point is below room temperature.

The thickness of the above non-magnetic layer is 4–50 angstroms.

If CoCr, CoCrPt, CoCrTa, SmCo, or NdFe film is laminated with Co, NiFe, NiFeCo film, then a ferromagnetic coupling is caused whereby coercive force of the magnetic layers in contact with CoCrPt is increased. CoCr, CoCrPt, CoCrTa, SmCo, or NdFe has a superior anti-corrosiveness than FeMn.

A Cr base layer underlying the first magnetic layer is further provided.

The third magnetic layer comprises one selected from the group consisting of NiFe, NiFeCo, FeCo, Co and an alloy including any of NiFe, NiFeCo, FeCo, Co as a main component.

The non-magnetic layer comprises one selected from the group consisting of Cu and an alloy including Cu as a main component.

The non-magnetic layer comprises one selected from the group consisting of Au and an alloy including Au as a main component.

The non-magnetic layer comprises one selected from the group consisting of Ag and an alloy including Ag as a main component.

The present invention also provided a magnetoresistive element comprising a first magnetic layer, and laminations of a second magnetic layer, a non-magnetic layer and a third magnetic layer. The laminations are adjacent to said first magnetic layer. The second magnetic layer and the third magnetic layer have different coercive forces, wherein the first magnetic layer comprises one selected from the group consisting of SmCo, NdFe and an alloy including any of SmCo, NdFe as a main component.

It is preferable that the SmCo layer comprises 0–50% of Sm, and the remaining part of alloy of Co and SmCo.

It is preferable that the NdFe layer comprises 0–50% of Nd and the remaining part of alloy of Fe and NdFe.

The thickness of the above individual magnetic layers is not more than 300 angstroms but not less than 4 angstroms. If the thickness is less than 4 angstroms, the Curie point is below room temperature.

The thickness of the above non-magnetic layer is 4–50 angstroms.

If CoCr, CoCrPt, CoCrTa, SmCo, or NdFe film is laminated with Co, NiFe, NiFeCo film, then a ferromagnetic coupling is caused whereby coercive force of the magnetic layers in contact with CoCrPt is increased. CoCr, CoCrPt, CoCrTa, SmCo, or NdFe has a superior anti-corrosiveness than FeMn.

The second magnetic layer comprises one selected from the group consisting of NiFe, NiFeCo, FeCo, Co and an alloy including any of NiFe, NiFeCo, FeCo, Co as a main component.

The third magnetic layer comprises one selected from the group consisting of NiFe, NiFeCo, FeCo, Co and an alloy including any of NiFe, NiFeCo, FeCo, Co as a main component.

The non-magnetic layer comprises one selected from the group consisting of Cu and an alloy including Cu as a main component.

The non-magnetic layer comprises one selected from the group consisting of Au and an alloy including Au as a main component.

The non-magnetic layer comprises one selected from the group consisting of Ag and an alloy including Ag as a main component.

The present invention also provides a magnetoresistive element comprising a first magnetic layer, and laminations of a non-magnetic layer and a third magnetic layer. The laminations are adjacent to said first magnetic layer. The first magnetic layer and the third magnetic layer have different coercive forces, wherein the first magnetic layer comprises one selected from the group consisting of SmCo, NdFe and an alloy including any of SmCo, NdFe as a main component.

It is preferable that the SmCo layer comprises 0–50% of Sm, and the remaining part of alloy of Co and SmCo.

It is preferable that the NdFe layer comprises 0–50% of Nd and the remaining part of alloy of Fe and NdFe.

The thickness of the above individual magnetic layers is not more than 300 angstroms but not less than 4 angstroms. If the thickness is less than 4 angstroms, the Curie point is below room temperature.

The thickness of the above non-magnetic layer is 4–50 angstroms.

If CoCr, CoCrPt, CoCrTa, SmCo, or NdFe film is laminated with Co, NiFe, NiFeCo film, then a ferromagnetic coupling is caused whereby coercive force of the magnetic layers in contact with CoCrPt is increased. CoCr, CoCrPt, CoCrTa, SmCo, or NdFe has a superior anti-corrosiveness than FeMn.

The third magnetic layer comprises one selected from the group consisting of NiFe, NiFeCo, FeCo, Co and an alloy including any of NiFe, NiFeCo, FeCo, Co as a main component.

The non-magnetic layer comprises one selected from the group consisting of Cu and an alloy including Cu as a main component.

The non-magnetic layer comprises one selected from the group consisting of Au and an alloy including Au as a main component.

The non-magnetic layer comprises one selected from the group consisting of Ag and an alloy including Ag as a main component.

The present invention also provides a method for forming a magnetoresistive element comprising a first magnetic layer, and laminations of a second magnetic layer, a non-magnetic layer and a third magnetic layer. The laminations are adjacent to said first magnetic layer. The second magnetic layer and the third magnetic layer have different coercive forces, wherein the first magnetic layer is made of one selected from the group consisting of CoCr, CoCrPt, CoCrTa, SmCo, NdFe and an alloy including any of CoCr, CoCrPt, CoCrTa, SmCo, NdFe as a main component, and the first magnetic layer is heated at a temperature in the range of 150–250° C.

The present invention also provides a method for forming a magnetoresistive element comprising a first magnetic layer, and laminations of a non-magnetic layer and a third magnetic layer. The laminations are adjacent to said first magnetic layer. The first magnetic layer and the third magnetic layer have different coercive forces, wherein the first magnetic layer is made of one selected from the group consisting of CoCr, CoCrPt, CoCrTa, SmCo, NdFe and an alloy including any of CoCr, CoCrPt, CoCrTa, SmCo, NdFe as a main component, and the first magnetic layer is heated at a temperature in the range of 150–250° C.

The present invention also provides a yoke magnetoresistive head including a magnetoresistive element retreated from an ABS face. The magnetoresistive element comprising a first magnetic layer, and laminations of a second magnetic layer, a non-magnetic layer and a third magnetic layer. The laminations are adjacent to said first magnetic layer. The second magnetic layer and the third magnetic layer have different coercive forces, wherein the first magnetic layer comprises one selected from the group consisting of CoCr, CoCrPt, CoCrTa and an alloy including any of CoCr, CoCrPt, CoCrTa as a main component.

A Cr base layer underlying the first magnetic layer is further provided.

The second magnetic layer comprises one selected from the group consisting of NiFe, NiFeCo, FeCo, Co and an alloy including any of NiFe, NiFeCo, FeCo, Co as a main component.

The third magnetic layer comprises one selected from the group consisting of NiFe, NiFeCo, FeCo, Co and an alloy including any of NiFe, NiFeCo, FeCo, Co as a main component.

The non-magnetic layer comprises one selected from the group consisting of Cu and an alloy including Cu as a main component.

The non-magnetic layer comprises one selected from the group consisting of Au and an alloy including Au as a main component.

The non-magnetic layer comprises one selected from the group consisting of Ag and an alloy including Ag as a main component.

The present invention also provides a yoke magnetoresistive head including a magnetoresistive element retreated from an ABS face. The magnetoresistive element comprises a first magnetic layer, and laminations of a non-magnetic layer and a third magnetic layer, the laminations being adjacent to said first magnetic layer. The first magnetic layer and the third magnetic layer have different coercive forces, wherein the first magnetic layer comprises one selected from the group consisting of CoCr, CoCrPt, CoCrTa and an alloy including any of CoCr, CoCrPt, CoCrTa as a main component.

A Cr base layer underlying the first magnetic layer is further provided.

The third magnetic layer comprises one selected from the group consisting of NiFe, NiFeCo, FeCo, Co and an alloy including any of NiFe, NiFeCo, FeCo, Co as a main component.

The non-magnetic layer comprises one selected from the group consisting of Cu and an alloy including Cu as a main component.

The non-magnetic layer comprises one selected from the group consisting of Au and an alloy including Au as a main component.

The non-magnetic layer comprises one selected from the group consisting of Ag and an alloy including Ag as a main component.

The present invention also provides a yoke magnetoresistive head including a magnetoresistive element retreated from an ABS face. The magnetoresistive element comprises a first magnetic layer, and laminations of a second magnetic layer, a non-magnetic layer and a third magnetic layer The laminations are adjacent to said first magnetic layer. The second magnetic layer and the third magnetic layer have different coercive forces, wherein the first magnetic layer comprises one selected from the group consisting of SmCo, NdFe and an alloy including any of SmCo, NdFe as a main component.

The second magnetic layer comprises one selected from the group consisting of NiFe, NiFeCo, FeCo, Co and an alloy including any of NiFe, NiFeCo, FeCo, Co as a main component.

The third magnetic layer comprises one selected from the group consisting of NiFe, NiFeCo, FeCo, Co and an alloy including any of NiFe, NiFeCo, FeCo, Co as a main component.

The non-magnetic layer comprises one selected from the group consisting of Cu and an alloy including Cu as a main component.

The non-magnetic layer comprises one selected from the group consisting of Au and an alloy including Au as a main component.

The non-magnetic layer comprises one selected from the group consisting of Ag and an alloy including Ag as a main component.

The present invention also provides a yoke magnetoresistive head including a magnetoresistive element retreated from an ABS face. The magnetoresistive element comprises a first magnetic layer, and laminations of a non-magnetic layer and a third magnetic layer. The laminations are adjacent to said first magnetic layer. The first magnetic layer and the third magnetic layer have different coercive forces, wherein the first magnetic layer comprises one selected from the group consisting of SmCo, NdFe and an alloy including any of SmCo, NdFe as a main component.

The third magnetic layer comprises one selected from the group consisting of NiFe, NiFeCo, FeCo, Co and an alloy including any of NiFe, NiFeCo, FeCo, Co as a main component.

The non-magnetic layer comprises one selected from the group consisting of Cu and an alloy including Cu as a main component.

The non-magnetic layer comprises one selected from the group consisting of Au and an alloy including Au as a main component.

The non-magnetic layer comprises one selected from the group consisting of Ag and an alloy including Ag as a main component.

The present invention also provides a shield magnetoresistive head including a magnetoresistive element sandwiched by soft magnetic layer shield films. The magnetoresistive element comprises a first magnetic layer, and laminations of a second magnetic layer, a non-magnetic layer and a third magnetic layer. The laminations are adjacent to said first magnetic layer. The second magnetic layer and the third magnetic layer have different coercive forces, wherein the first magnetic layer comprises one selected from the group consisting of CoCr, CoCrPt, CoCrTa and an alloy including any of CoCr, CoCrPt, CoCrTa as a main component.

A Cr base layer underlying the first magnetic layer is further provided.

The second magnetic layer comprises one selected from the group consisting of NiFe, NiFeCo, FeCo, Co and an alloy including any of NiFe, NiFeCo, FeCo, Co as a main component.

The third magnetic layer comprises one selected from the group consisting of NiFe, NiFeCo, FeCo, Co and an alloy including any of NiFe, NiFeCo, FeCo, Co as a main component.

The non-magnetic layer comprises one selected from the group consisting of Cu and an alloy including Cu as a main component.

The non-magnetic layer comprises one selected from the group consisting of Au and an alloy including Au as a main component.

The non-magnetic layer comprises one selected from the group consisting of Ag and an alloy including Ag as a main component.

The present invention also provides a shield magnetoresistive head including a magnetoresistive element sandwiched by soft magnetic layer shield films. The magnetoresistive element comprises a first magnetic layer, and laminations of a non-magnetic layer and a third magnetic layer. The laminations are adjacent to said first magnetic layer. The first magnetic layer and the third magnetic layer have different coercive forces, wherein the first magnetic layer comprises one selected from the group consisting of CoCr, CoCrPt, CoCrTa and an alloy including any of CoCr, CoCrPt, CoCrTa as a main component.

A Cr base layer underlying the first magnetic layer is further provided.

The third magnetic layer comprises one selected from the group consisting of NiFe, NiFeCo, FeCo, Co and an alloy including any of NiFe, NiFeCo, FeCo, Co as a main component.

The non-magnetic layer comprises one selected from the group consisting of Cu and an alloy including Cu as a main component.

The non-magnetic layer comprises one selected from the group consisting of Au and an alloy including Au as a main component.

The non-magnetic layer comprises one selected from the group consisting of Ag and an alloy including Ag as a main component.

The present invention also provides a shield magnetoresistive head including a magnetoresistive element sandwiched by soft magnetic layer shield films. The magnetoresistive element comprises a first magnetic layer, and laminations of a second magnetic layer, a non-magnetic layer and a third magnetic layer. The laminations are adjacent to said first magnetic layer. The second magnetic layer and the third magnetic layer have different coercive forces, wherein the first magnetic layer comprises one selected from the group consisting of SmCo, NdFe and an alloy including any of SmCo, NdFe as a main component.

The second magnetic layer comprises one selected from the group consisting of NiFe, NiFeCo, FeCo, Co and an alloy including any of NiFe, NiFeCo, FeCo, Co as a main component.

The third magnetic layer comprises one selected from the group consisting of NiFe, NiFeCo, FeCo, Co and an alloy including any of NiFe, NiFeCo, FeCo, Co as a main component.

The non-magnetic layer comprises one selected from the group consisting of Cu and an alloy including Cu as a main component.

The non-magnetic layer comprises one selected from the group consisting of Au and an alloy including Au as a main component.

The non-magnetic layer comprises one selected from the group consisting of Ag and an alloy including Ag as a main component.

The present invention also provides a shield magnetoresistive head including a magnetoresistive element sandwiched by soft magnetic layer shield films. The magnetoresistive element comprises a first magnetic layer, and laminations of a non-magnetic layer and a third magnetic layer. The laminations are adjacent to said first magnetic layer. The first magnetic layer and the third magnetic layer have different coercive forces, wherein the first magnetic layer comprises one selected from the group consisting of SmCo, NdFe and an alloy including any of SmCo, NdFe as a main component.

The third magnetic layer comprises one selected from the group consisting of NiFe, NiFeCo, FeCo, Co and an alloy including any of NiFe, NiFeCo, FeCo, Co as a main component.

The non-magnetic layer comprises one selected from the group consisting of Cu and an alloy including Cu as a main component.

The non-magnetic layer comprises one selected from the group consisting of Au and an alloy including Au as a main component.

The non-magnetic layer comprises one selected from the group consisting of Ag and an alloy including Ag as a main component.

The present invention also provides a magnetoresistive sensor comprising the following elements. A magnetoresistive sensor comprises a first magnetic layer, and laminations of a second magnet layer, a non-magnetic layer and a third magnetic layer. The laminations are adjacent to said first magnetic layer. The second magnetic layer and the third magnetic layer have different coercive forces, wherein at least one of the second and third magnetic layers comprises one selected from the group consisting of NiFe, NiFeCo, FeCo, Co. A current applying means is provided for applying a current to the magnetoresistive sensor. A sensor means is provided for sensing a variation in resistivity of the magnetoresistive sensor based upon a rotational difference of magnetization of the third magnetic layer from a direction of magnetization of the second magnetic layer in accordance with a magnetic field to the detected.

The second magnetic layer comprises one selected from the group consisting of Co and NiFeCo, and wherein the third magnetic layer one selected from the group consisting of NiFe, and NiFeCo.

The non-magnetic layer comprises one selected from the group consisting of Cu, Au, Ag, an alloy including any of Cu, Au, and Ag and a mixture thereof.

The present invention also provides a magnetic recording and replaying system comprising the following elements. A magnetic recording medium is provided having a plurality of tracks for recording data. A magnetic convector is provided for converting a magnetic intensity into an electric intensity. The magnetic convector are maintained adjacent to the magnetic recording medium during a relative motion in relation to the magnetic recording medium. The magnetic convector comprises first, second and third ferromagnetic layers which are separated by non-magnetic metal layers. The second and third ferromagnetic layers are vertical to the magnetic recording medium. The first magnetic layer are adjacent to the second magnetic layer. The first magnetic layer comprises one selected from the group consisting of CoCr, CoCrPt, CoCrTa, SmCo, NdFe and an alloy including any of CoCr, CoCrPt, CoCrTa, SmCo, NdFe as a main component. An actuator means is coupled to the magnetic convector for moving the magnetic convector to a selected one of the tracks of the magnetic recording medium. A detector means is coupled to the magnetic convector for detecting variation in internal resistance of the magnetic convector by a magnetic field provided from a magnetic domain recorded in the magnetic recording medium.

A capping layer is further provided wherein a resistance sensor is provided on the third magnetic layer, and a lead is furthermore provided on the capping layer for connecting the magnetic convector to the detector means.

Figure 2:
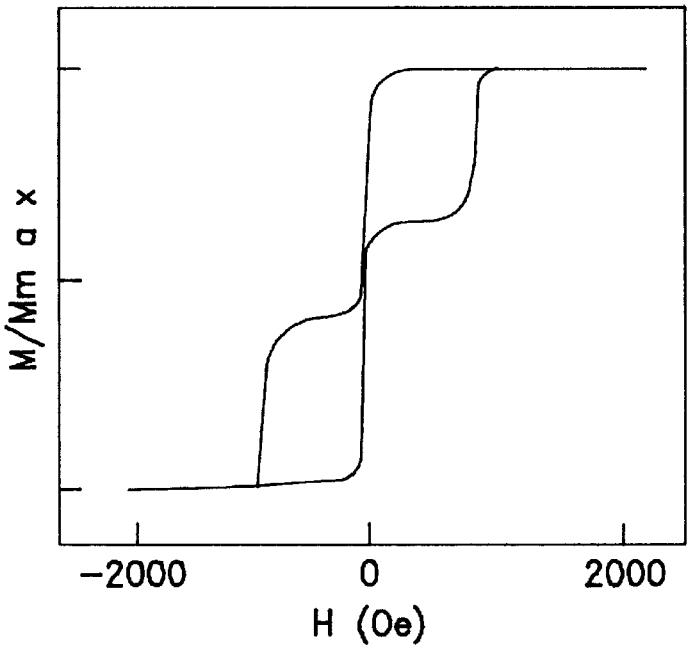
FIG. 2 is a diagram illustrative of an M—H loop of Cu/NiFe film over glass/Cr/CoCrPt film.
Figure 3:
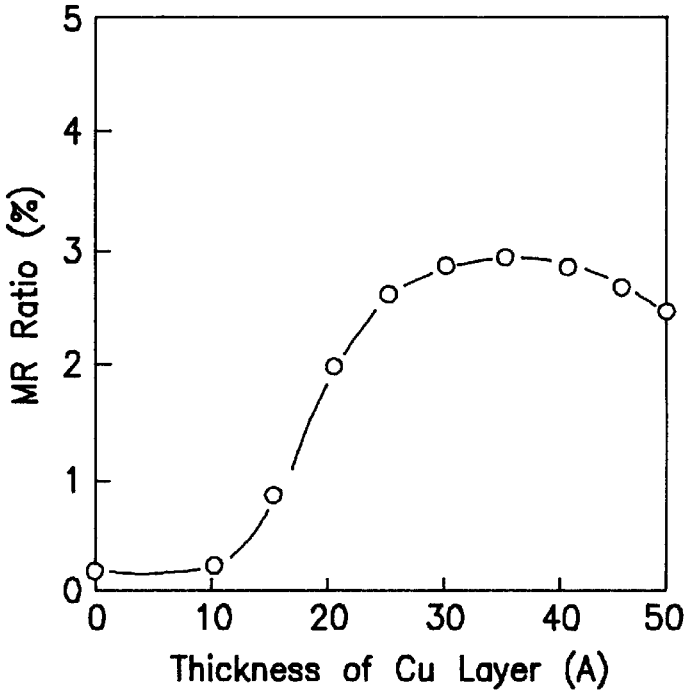
FIG. 3 is a diagram illustrative of variation in MR ratio versus thickness of Cu layer.

A first embodiment according to the present invention will be described with reference to FIGS. 1, 2 and 3. A magnetoresistive element of glass/Cr/CoCrPt/Cu/NiFe was prepared. The layer CoCrPt comprises 72% of Co, 16% of Cr and 12% of Pt. FIG. 1 is a diagram illustrative of an M—H loop in-plane direction of glass/Cr(50A)/CoCrPt(150A) film. FIG. 2 is a diagram illustrative of an M—H loop of Cu(25A)/NiFe(100A) film over glass/Cr(25A)/CoCrPt (100A) film. FIG. 3 is a diagram illustrative of variation in MR ratio versus thickness of the Cu layer.

Figure 4:
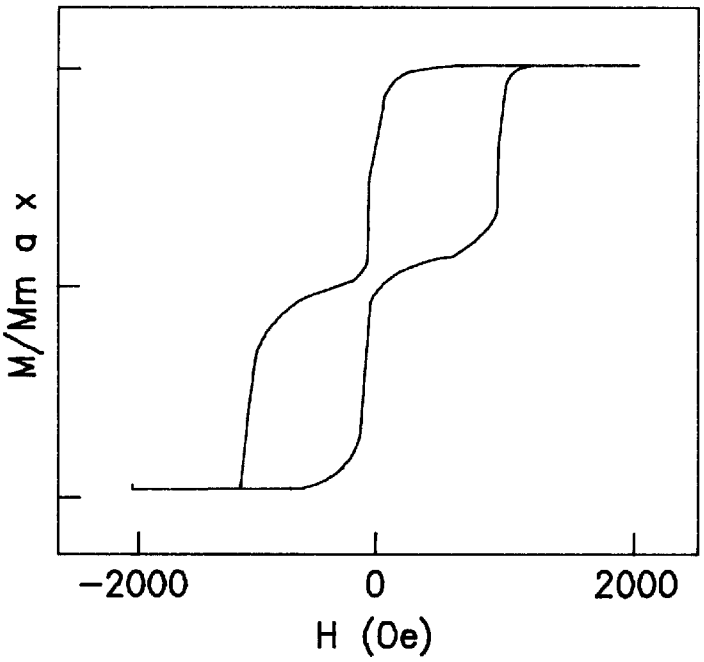
FIG. 4 is a diagram illustrative of an M—H loop of glass/Cr/CoCrPt/Co/Cu/NiFe film.
Figure 5:
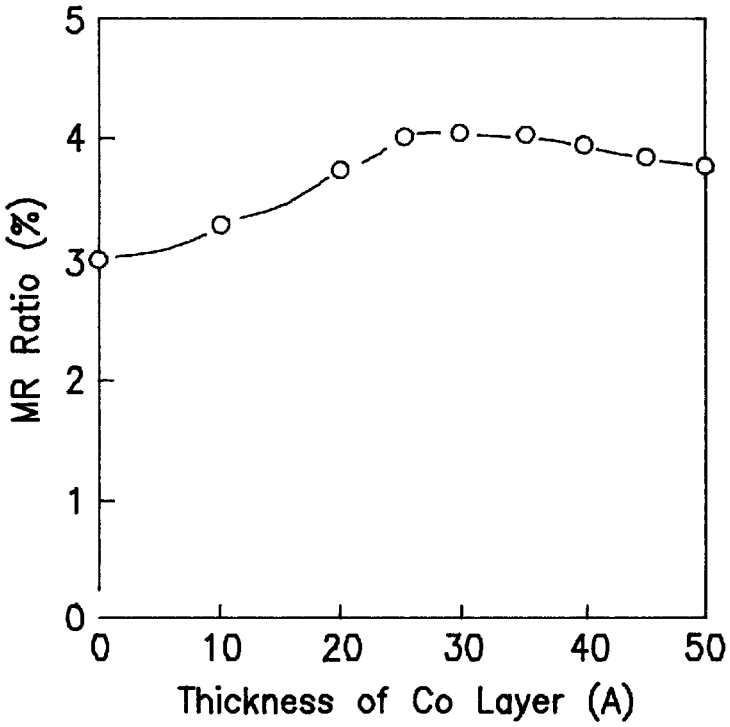
FIG. 5 is a diagram illustrative of variations in MR ratio versus thickness of Co layer.

A second embodiment according to the present invention will be described with reference to FIGS. 4 and 5. A magnetoresistive element of glass/Cr/CoCrPt/Co/Cu/NiFe was prepared. The layer CoCrPt comprises 78% of Co, 14% of Cr and 8% of Pt. FIG. 4 is a diagram illustrative of an M—H loop of glass/Cr/CoCrPt/Co/Cu/NiFe film. FIG. 5 is a diagram illustrative of variation in MR ratio versus thickness of Co layer.

A third embodiment according to the present invention will be described. A magnetoresistive element of glass/SmCo/NiFe/Cu/NiFe was prepared. The M—H loop in plane direction of the SmCo layer was measured. An inversion magnetic field was 700 Oe. Further, an artificial lattice glass/SmCo(200A)/NiFe(50A)/Cu(25A)/NiFe(50A) was prepared for MR measurement being made 4% of variation in resistivity was observed. Furthermore, an artifical lattice glass/NdFe(200A)/NiFe(50A)/Cu(25A)/NiFe(50A) was prepared for MR measurement being made 3.5% of variation in resistivity was observed.

Figure 6:
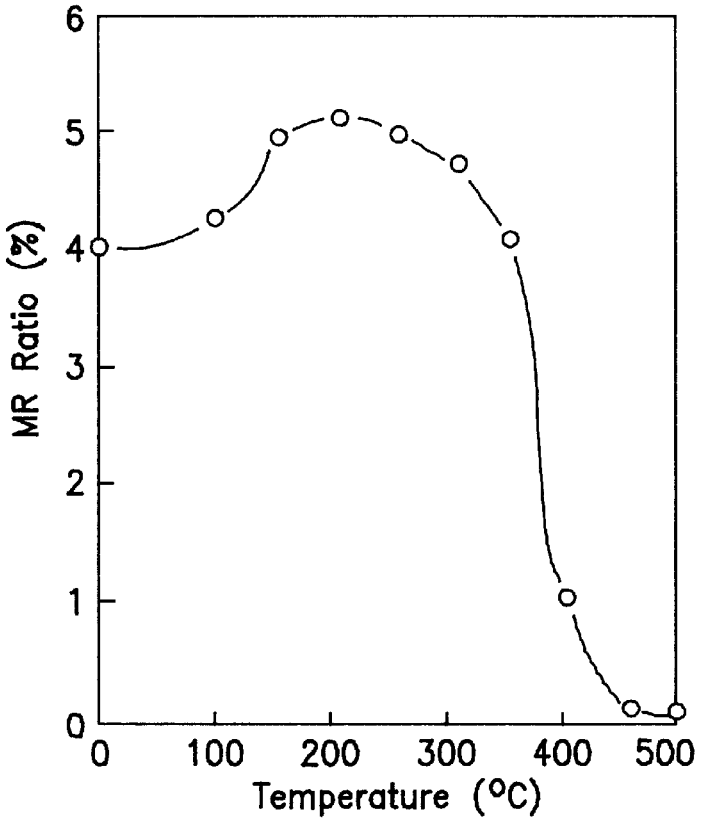
FIG. 6 is a diagram illustrative of variation in MR ratio versus temperature of heat treatment.

FIG. 6 is a diagram illustrative of variation in MR ratio versus temperature of heat treatment to the medium of the second embodiment for 1 hour. The MR ratio varied as illustrated in FIG. 6. In the range of 150–250° C., more than 5% of the MR ratio was obtained.

The life time, namely the half-MR ratio time, was measured at 25° C., a humidity 80% and 25 years of the life time was observed. For comparison, Ta/NiFe/Cu/NiFe/FeMn spin bulb was prepared to measure the life time. The measured life time was only 10 days.

Yoke magnetoresistive heads utilizing the above magnetoresistive elements Cr/CoCrPt/Co/Cu/NiFe and Cr/CoCrTa/Co/Cu/NiFe were prepared. The head was used for a contact recording with the vertical recording medium of glass/(Ta/NiFe)5/Cr/CoCrTa/C. If the heads utilizing Cr/CoCrPt/Co/Cu/NiFe, the output was 1.2 mV. If the heads utilizing Cr/CoCrTa/Co/Cu/NiFe, the output was 1.1 mV. The length of the record mark was 5 micrometers. If the permalloy was applied to the shield MR element for the contact recording, then the output was 0.25 mV.

A shield magnetoresistive head utilizing the above magnetoresistive elements Cr/CoCrPt/Co/Cu/NiFe was also prepared. This MR head having been used for reply of he magnetic signals, the output was two times higher than the shield MR head using the anisotropic MR film.

What is claimed is:

1. A magnetoresistive element comprising:

a first magnetic layer; and laminations of a second magnetic layer, a non-magnetic layer directly on and in contact with the second magnetic layer and a third magnetic layer directly on and in contact with the non-magnetic layer, the second magnetic layer being directly on and in contact with said first magnetic layer, the second magnetic layer and the third magnetic layer having different coercive forces, wherein the first magnetic layer comprises one selected from the group consisting of CoCrTa, and an alloy of CoCrTa as a main component, wherein each of said second and third magnetic layers comprise one selected from the group consisting of NiFe, NiFeCo, Co and an alloy including any of NiFe, NiFeCo, FeCo, Co as a main component.

2. The magnetoresistive element as claimed in claim 1, further comprising a Cr base layer underlying the first magnetic layer.

3. The magnetoresistive element as claimed in claim 1, wherein the non-magnetic layer comprises one selected from the group consisting of Cu and an alloy including Cu as a main component.

4. The magnetoresistive element as claimed in claim 1, wherein the non-magnetic layer comprises one selected from the group consisting of Au and an alloy including Au as a main component.

5. The magnetoresistive element as claimed in claim 1, wherein the non-magnetic layer comprises one selected from the group consisting of Ag and an alloy including Ag as a main component.

6. A magnetoresistive element comprising:

a first magnetic layer; and laminations of a second magnetic layer, a non-magnetic layer directly on and in contact with the second magnetic layer and a third magnetic layer directly on and in contact with the non-magnetic layer, the second magnetic layer being directly on and in contact with said first magnetic layer, the second magnetic layer and the third magnetic layer having different coercive forces, wherein the first magnetic layer comprises one selected from the group consisting of NdFe and an alloy of NdFe as a main component, wherein each of said second and third magnetic layers comprise one selected from the group consisting of NiFe, NiFeCo, FeCo, Co and an alloy including any of NiFe, NiFeCo, FeCo, Co as a main component.

7. The magnetoresistive element as claimed in claim 6, wherein the non-magnetic layer comprises one selected from the group consisting of Cu and an alloy including Cu as a main component.

8. The magnetoresistive element as claimed in claim 6, wherein the non-magnetic layer comprises one selected from the group consisting of Au and an alloy including Au as a main component.

9. The magnetoresistive element as claimed in claim 6, wherein the non-magnetic layer comprises one selected from the group consisting of Ag and an alloy including Ag as a main component.

10. A yoke magnetoresistive head including a magnetoresistive element retreated from an ABS face, the magnetoresistive element comprising:

a first magnetic layer; and laminations of a second magnetic layer, a non-magnetic layer directly on and in contact with the second magnetic layer and a third magnetic layer directly on and in contact with the non-magnetic layer, the second magnetic layer being directly on and in contact with said first magnetic layer, the second magnetic layer and the third magnetic layer having different coercive forces, wherein the first magnetic layer comprises one selected from the group consisting of CoCrTa and an alloy of CoCrTa as a main component, wherein each of said second and third magnetic layers comprise one selected from the group consisting of NiFe, NiFeCo, FeCo, Co and an alloy including any of NiFe, NiFeCo, FeCo, Co as a main component.

11. The yoke magnetoresistive head as claimed in claim 10, further comprising a Cr base layer underlying the first magnetic layer.

12. The yoke magnetoresistive head as claimed in claim 10, wherein the non-magnetic layer comprises one selected from the group consisting of Cu and an alloy including Cu as a main component.

13. The yoke magnetoresistive head as claimed in claim 10, wherein the non-magnetic layer comprises one selected from the group consisting of Au and an alloy including Au as a main component.

14. The yoke magnetoresistive head as claimed in claim 10, wherein the non-magnetic layer comprises one selected from the group consisting of Ag and an alloy including Ag as a main component.

15. A yoke magnetoresistive head including a magnetoresistive element retreated from an ABS face, the magnetoresistive element comprising:

a first magnetic layer; and laminations of a second magnetic layer, a non-magnetic layer directly on and in contact with the second magnetic layer and a third magnetic layer directly on and in contact with the non-magnetic layer, the second magnetic layer being directly on and in contact with said first magnetic layer, the second magnetic layer and the third magnetic layer having different coercive forces, wherein the first magnetic layer comprises one selected from the group consisting of NdFe and an alloy of NdFe as a main component, wherein each of said second and third magnetic layers comprise one selected from the group consisting of NiFe, NiFeCo, FeCo, Co and an alloy including any of NiFe, NiFeCo, FeCo, Co as a main component.

16. The yoke magnetoresistive head as claimed in claim 15, wherein the non-magnetic layer comprises one selected from the group consisting of Cu and an alloy including Cu as a main component.

17. The yoke magnetoresistive head as claimed in claim 15, wherein the non-magnetic layer comprises one selected from the group consisting of Au and an alloy including Au as a main component.

18. The yoke magnetoresistive head as claimed in claim 15, wherein the non-magnetic layer comprises one selected from the group consisting of Ag and an alloy including Ag as a main component.

19. A shield magnetoresistive head including a magnetoresistive element sandwiched by soft magnetic layer shield films, the magnetoresistive element comprising:

a first magnetic layer; and laminations of a second magnetic layer, a non-magnetic layer directly on and in contact with the second magnetic layer and a third magnetic layer directly on and in contact with the non-magnetic layer, the second magnetic layer being directly on and in contact with said first magnetic layer, the second magnetic layer and the third magnetic layer having different coercive forces, wherein the first magnetic layer comprises one selected from the group consisting of CoCrTa and an alloy of CoCrTa as a main component, wherein each of said second and third magnetic layers comprise one selected from the group consisting of NiFe, NiFeCo, FeCo, Co and an alloy including any of NiFe, NiFeCo, FeCo, Co as a main component.

20. The shield magnetoresistive head as claimed in claim 19, further comprising a Cr base layer underlying the first magnetic layer.

21. The shield magnetoresistive head as claimed in claim 19, wherein the non-magnetic layer comprises one selected from the group consisting of Cu and an alloy including cu as a main component.

22. The shield magnetoresistive head as claimed in claim 19, wherein the non-magnetic layer comprises one selected from the group consisting of Au and an alloy including Au as a main component.

23. The shield magnetoresistive head as claimed in claim 19, wherein the non-magnetic layer comprises one selected from the group consisting of Ag and an alloy including Ag as a main component.

24. A shield magnetoresistive head including a magnetoresistive element sandwiched by soft magnetic layer shield films, the magnetoresistive element comprising:

a first magnetic layer; and laminations of a second magnetic layer, a non-magnetic layer directly on and in contact with the second magnetic layer and a third magnetic layer directly on and in contact with the non-magnetic layer, the second magnetic layer being directly on and in contact with said first magnetic layer, the second magnetic layer and the third magnetic layer having different coercive forces, wherein the first magnetic layer comprises one selected from the group consisting of NdFe and an alloy of NdFe as a main component, wherein each of said second and third magnetic layers comprise one selected from the group consisting of NiFe, NiFeCo, FeCo, Co and an alloy including any of NiFe, NiFe, NiFeCo, Co as a main component.

25. The shield magnetoresistive head as claimed in claim 24, wherein the non-magnetic layer comprises one selected from the group consisting of Cu and an alloy including Cu as a main component.

26. The shield magnetoresistive head as claimed in claim 24, wherein the non-magnetic layer comprises one selected from the group consisting of Au and an alloy including Au as a main component.

27. The shield magnetoresistive head as claimed in claim 24, wherein the non-magnetic layer comprises one selected from the group consisting of Ag and an alloy including Ag as a main component.

28. A magnetoresistive sensor comprising:

a magnetoresistive sensor comprising a first magnetic layer and lamination of a second magnetic layer, a non-magnetic layer directly on and in contact with the second magnetic layer and a third magnetic layer directly on and in contact with the non-magnetic layer, the second magnetic layer being directly on and in contact with said first magnetic layer, the second magnetic layer and the third magnetic layer having different coercive forces, wherein the first magnetic layer comprises one selected from the group consisting of NdFe and CoCrTa, the second magnetic layer comprises one selected from the group consisting of Co and NiFeCo, and the third magnetic layer comprises one selected from the group consisting of NiFe and NiFeCo;

a current applying means for applying a current to the magnetoresistive sensor; and a sensor means for sensing a variation in resistivity of the magnetoresistive sensor based upon a rotational difference of magnetization of the third magnetic layer from a direction of magnetization of the second magnetic layer in according with a magnetic field to be detected.

29. The magnetoresistive sensor as claimed in claim 28, wherein the non-magnetic layer comprises one selected from the group consisting of Cu, Au, Ag, an alloy including any of Cu, Au, and Ag and a mixture thereof.

30. The sensor of claim 28, wherein said first magnetic layer comprises NdFe or an alloy thereof as a main component.

31. The sensor of claim 28, wherein said first magnetic layer comprises CoCrTa or an alloy thereof as a main component.

* * * * *